US008235582B2

(12) United States Patent
Kalidindi

(10) Patent No.: US 8,235,582 B2
(45) Date of Patent: Aug. 7, 2012

(54) METHOD FOR ALTERNATELY SIFTING AND BLENDING POWDERS IN THE SAME OPERATION

(76) Inventor: Sanyasi R. Kalidindi, East Brunswick, NJ (US)

( * ) Notice: Subject to any disclaimer, the term of this patent is extended or adjusted under 35 U.S.C. 154(b) by 549 days.

(21) Appl. No.: 12/587,176

(22) Filed: Oct. 3, 2009

(65) Prior Publication Data

US 2010/0085834 A1 Apr. 8, 2010

Related U.S. Application Data

(60) Provisional application No. 61/103,621, filed on Oct. 8, 2008.

(51) Int. Cl.
*B01F 9/08* (2006.01)

(52) U.S. Cl. ..... 366/226; 366/223

(58) Field of Classification Search ..... 366/222, 366/223, 226; 209/280, 304, 288, 296
See application file for complete search history.

(56) References Cited

U.S. PATENT DOCUMENTS

| | | | | |
|---|---|---|---|---|
| 15,455 | A * | 7/1856 | Mendenhall et al. | 209/296 |
| 74,954 | A * | 2/1868 | Tingley | 366/226 |
| 79,821 | A * | 7/1868 | Gilbert | 366/226 |
| 99,985 | A * | 2/1870 | Wegner et al. | 366/226 |
| 192,540 | A * | 6/1877 | Stoll | 366/226 |
| 269,129 | A * | 12/1882 | Smith | 366/222 |
| 400,621 | A * | 4/1889 | Winkler | 209/295 |
| 6,308,704 | B1 | 10/2001 | Wennerberg | |
| 6,776,517 | B2 | 8/2004 | Afnan et al. | |
| 7,056,010 | B2 | 6/2006 | Davies | |
| 2010/0149903 | A1 | 6/2010 | Imai et al. | |

FOREIGN PATENT DOCUMENTS

| | | |
|---|---|---|
| KR | 10-0359593 B1 | 2/1997 |
| KR | 100140014 | 3/1998 |
| KR | 100769233 | 7/2006 |
| KR | 10-2008-0027817 A | 3/2008 |

* cited by examiner

*Primary Examiner* — David Sorkin
(74) *Attorney, Agent, or Firm* — Michael R. Philips

(57) ABSTRACT

A tumbler is mounted for rotation around a trunnion with a screen fixedly mounted to a portion of the trunnion residing within the tumbler. A multiple blade paddle is mounted to a shaft that is rotatably supported through the trunnion. The paddle blades are formed with angular edges. As the tumbler rotates and the paddle rotates, powder is repeatedly dropped onto the screen to be sifted with the aid of the paddle. Rotating the tumbler further drops unsifted portions of the powder from the screen to mix with additional powder in the tumbler body. Thus, sifting and blending of powders is accomplished in one single operation.

9 Claims, 4 Drawing Sheets

METHOD FOR ALTERNATELY SIFTING AND BLENDING POWDERS IN THE SAME OPERATION

RELATED APPLICATION

This application claims the benefit of provisional patent application No. 61/103,621 filed Oct. 8, 2008.

FIELD OF THE INVENTION

The present invention relates to the field of powder processing, and more particularly to a method for alternately sifting and blending a mix of powders in the same operation.

BACKGROUND OF THE INVENTION

The manufacture of pharmaceuticals by blending several powders in production quantities requires careful control to ensure uniformity within a given batch and from one batch to another. A typical pharmaceutical may involve five or more ingredients in powder form. Often there is only a single active ingredient that comprises a very small fraction of the total amount of the ingredients to be combined, typically measured in micrograms or milligrams. Unless the mixing is thorough, parts of the production batch will have an insufficient amount of active ingredient to be effective, and parts of the production batch will have an excess amount of active ingredient and be potentially detrimental. In most cases, when the blending is complete the powder is either compressed into tablets or filled into capsules to provide measured dose quantities. If the blending is not thorough, the measured dose quantities will not be equal.

Blending of powders is commonly done in a tumbler, a closed container that is caused to rotate, typically end over end, to mix the multiple powder ingredients to form a homogeneous blend. Many tumbling blenders include an intensifier bar that is rotated at high speed within the blender. A known type blender that effectively mixes powders is known as a V-blender or a double cone blender. The thoroughness of the mixing depends on the characteristics of the individual ingredients and the length of time the tumbler is operated. Using a tumbling blender, such as a V-blender with an intensifier bar, yields a more uniform blend than a stationary blender, such as a ribbon blender. However, even blending of a micronized active ingredient with other ingredients in a tumbling blender with an intensifier bar does not always yield a uniform blend. In some situations, a micronized active ingredient will develop a static charge and form small aggregates which do not break up during the blending process, even with an intensifier bar. To correct the problem of aggregated powder, the powder batch may be first blended, then removed from the blender and sifted or milled, and then re-loaded into the blender to be blended again. This multiple handling process is time consuming and generates dust from the powder ingredients.

An improvement on the basic tumbler is taught in U.S. Pat. No. 7,056,010 to Davies for a Blender For Mixing Particulate Solid Materials Including An Internal Baffle. While the Davies blender appears to improve the effectiveness of blending multiple powders, the requirement for breaking down powder clumps still exists.

Certain powders are blended with an included ingredient specifically intended for coating particles of other powders, for example a lubricating powder. The degree of adhesion of a coating ingredient to a powder particle may be improved by the application of pressure, rather than simply allowing the components to randomly contact one another.

SUMMARY OF THE INVENTION

The present invention provides a practical and heretofore unknown method for efficiently sifting and blending powders thoroughly in a single operation. The invention utilizes apparatus with an arcuate screen that is mounted within a tumbling blender. As the blender tumbles end over end, the powders in the blender are dropped onto the concave surface of the arcuate screen to be sifted for improved mixing. A paddle is mounted for rotation concentrically with the screen to provide additional powder mixing and to encourage breakdown of the powder clumps for passing through the screen. In a first embodiment of the invention, the paddle has several blades to assist passing the powder through the screen by forming edge portions of the paddle at an angle, also encouraging the coating of the finer particulate ingredients onto the larger particulate ingredients. In a second embodiment of the invention, the paddle is in the form of multiple cutters that break down powder clumps.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
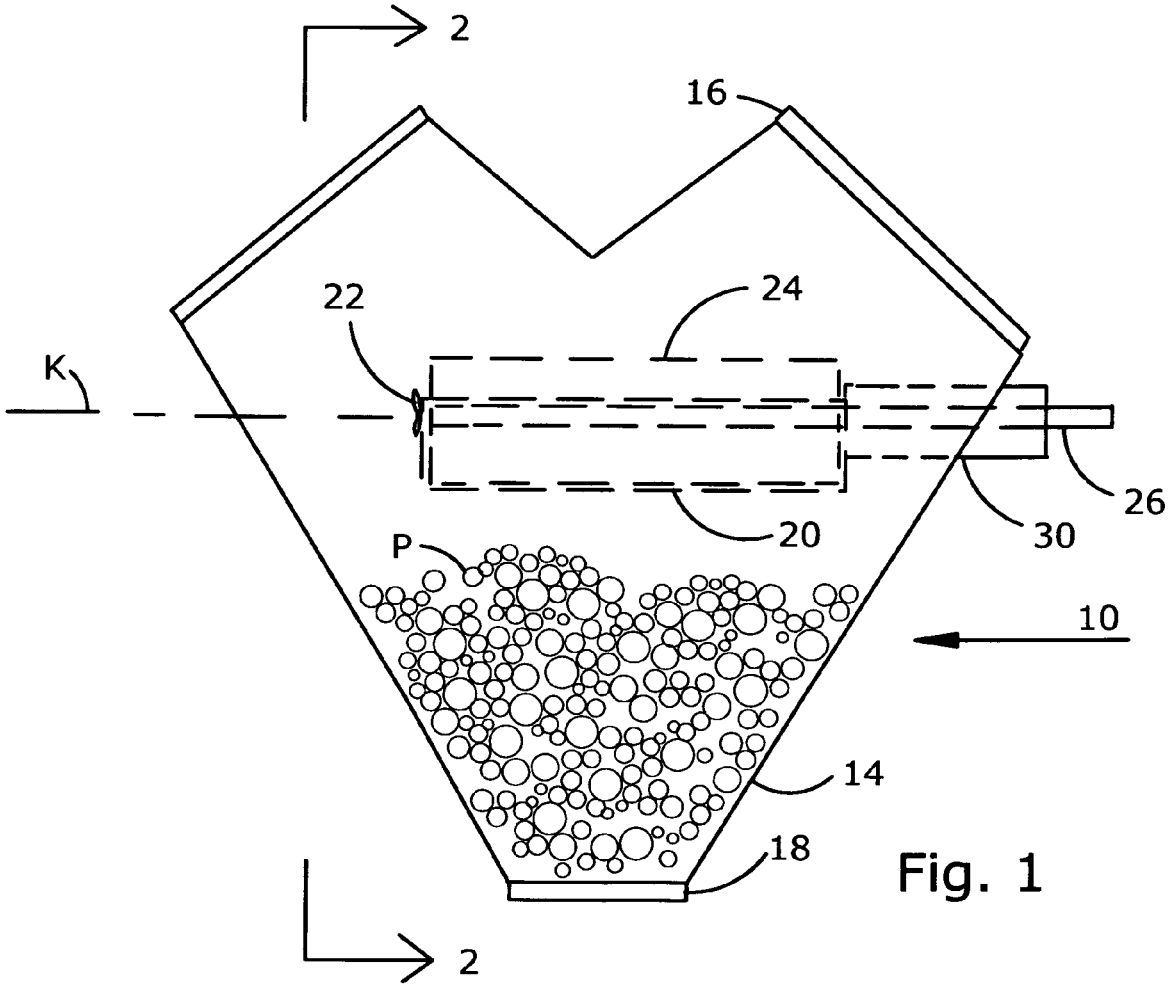
FIG. 1 is a front elevation view of the present invention apparatus for sifting and blending powders as utilizing a V-blender type tumbler.

Referring to FIG. 1, an apparatus 10 used for sifting and blending powders is shown in front elevation. A tumbler 14, e.g. a V-blender, is shown in upright orientation. V-blenders, as are known, are effective by dividing and re-combining the powders as the blender rotates end over end. While the preferred embodiment of the invention incorporates a V-blender, the principles disclosed herein are deemed to pertain to various tumbling blender geometries. Tumbler 14 is mounted for rotation around axis K. A pair of top closures 16 and a bottom closure 18 are mounted to the top and bottom respectively of tumbler 14 to contain ingredients therein. A trunnion 30 is fixedly mounted to the wall of tumbler 14 to be concentric with axis K with a portion of trunnion 30 extending into the free space within tumbler 14. A semi-tubular screen 20 is fixedly mounted to trunnion 30 by means of a plurality of fasteners 22, e.g. long shafted screws. A drive shaft 26 which passes through a bore through trunnion 30 with an attached agitator, preferably a paddle 24, movably mounted to the inner end thereof. A first drive device (not shown) is connected to rotate trunnion 30 and tumbler 14, and a second drive device (not shown) is connected to rotate shaft 26 and paddle 24. In this manner, tumbler 14 may be rotated at a different speed, e.g. slower, than paddle 24. Alternately, tumbler 14 and paddle 24 may be rotated in opposite directions. A batch of powder P resides at about 60% of the volume of tumbler 14.

Figure 2C:
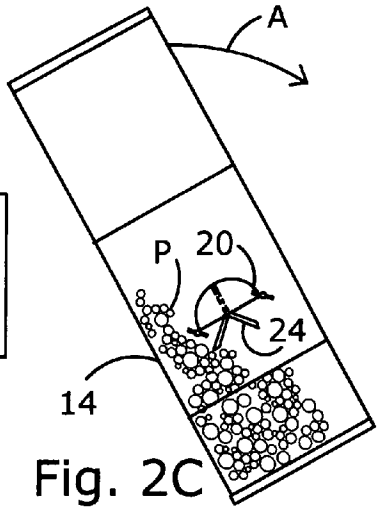
FIGS. 2A-2F are a series of side elevation views taken in the direction indicated by line 2-2 of FIG. 1 to portray the steps of the invention method.
Figure 2B:
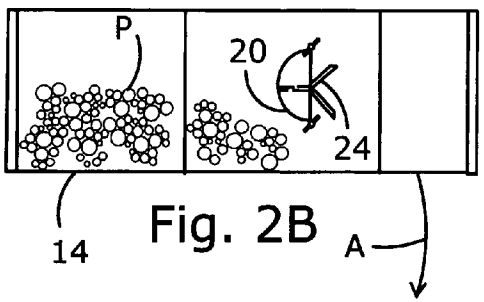
Figure 2A:
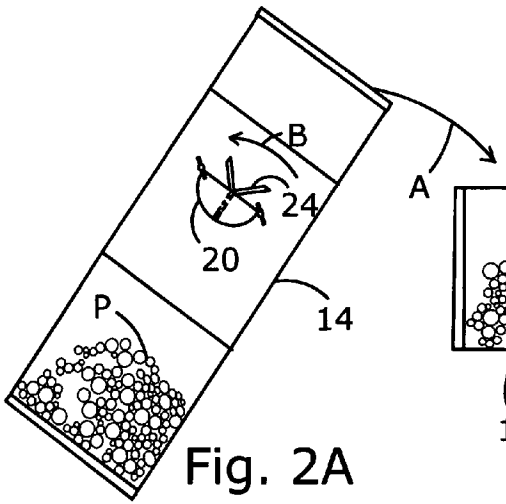
Figure 2F:
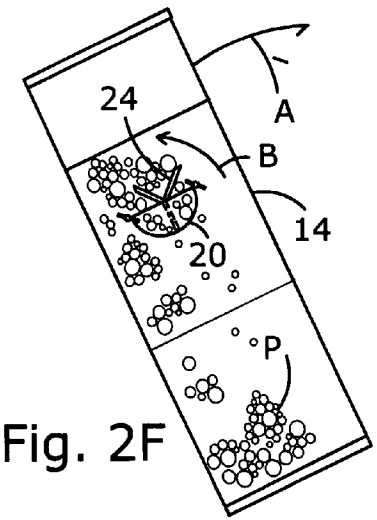
Figure 2E:
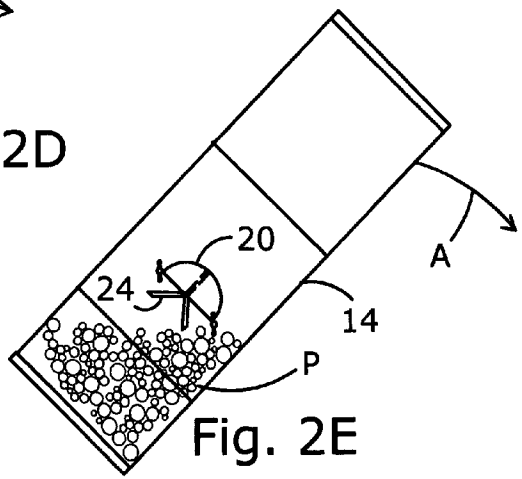
Figure 2D:
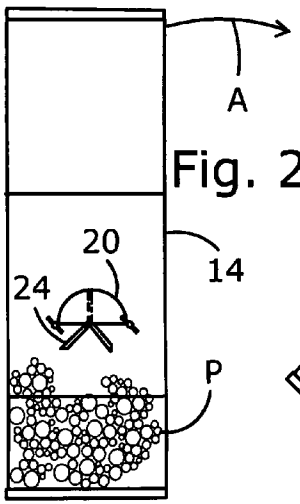

Referring now to FIGS. 2A-2F, tumbler 14 is shown in sequential side elevation views as rotating in the direction indicated by arrow A. FIGS. 2A-2F are taken in the direction indicated by line 2-2 of FIG. 1 in order to show the interior screen and paddle features thereof more clearly. FIG. 2A portrays tumbler 14 with screen 20 fixedly mounted thereto and paddle 24 rotatably mounted therein. FIG. 2A shows tumbler 14 in a first angular orientation beginning the process of being rotated to sift and blend powder P held therein. The batch of powder P is beginning to shift toward the right side of tumbler 14. Whereas tumbler 14 and screen 20 are fixedly connected, screen 20 turns at the same speed as tumbler 14 in direction A. Paddle 24 is driven to rotate in the direction indicated by arrow B, i.e. opposite to the rotational direction of tumbler 14 and screen 20. In this manner, the effectiveness of paddle 24 in agitating and sifting powder through screen 20, and the effectiveness of mixing powder, is improved. While illustrated with paddle 24 rotating in a direction opposite to the direction of tumbler 14, a rotation in the same direction as tumbler 14, or at the same or different speed as tumbler 14, may be useful in various production situations. FIG. 2B shows tumbler 14 is in a substantially horizontal orientation with powder P resting on a side (shown as the bottom) of tumbler 14. FIG. 2C shows tumbler 14 approaching complete vertical inversion, with powder P falling past screen 20. FIG. 2D shows tumbler 14 in fully vertical inverted orientation with the batch of powder P having passed screen 20. FIG. 2E shows tumbler 14 beyond the inverted position with powder P partly in contact with the sidewall and partly in contact with the end of tumbler 14 opposite to the open end of screen 20. In FIG. 2F, tumbler 14 is approaching the vertically upright orientation with a significant portion of powder P dropping into screen 20 and additional portions of powder P dropping past screen 20. The portion of powder P caught in screen 20 is sifted with the aid of paddle 24 to fall through screen 20 and merge with the portion of powder P at the bottom of tumbler 14. With each rotation of tumbler 14, a different portion of powder P is sifted through screen 20 and other portions of powder P are tumbled in a repetitive sifting and blending operation. Whereas tumbler 14 is being continuously rotated, only some of the portion of powder P caught in screen 20 will be sifted through screen 20 by the time tumbler 14 rotates and drops the unsifted portion of powder P from screen 20.

Figure 3:
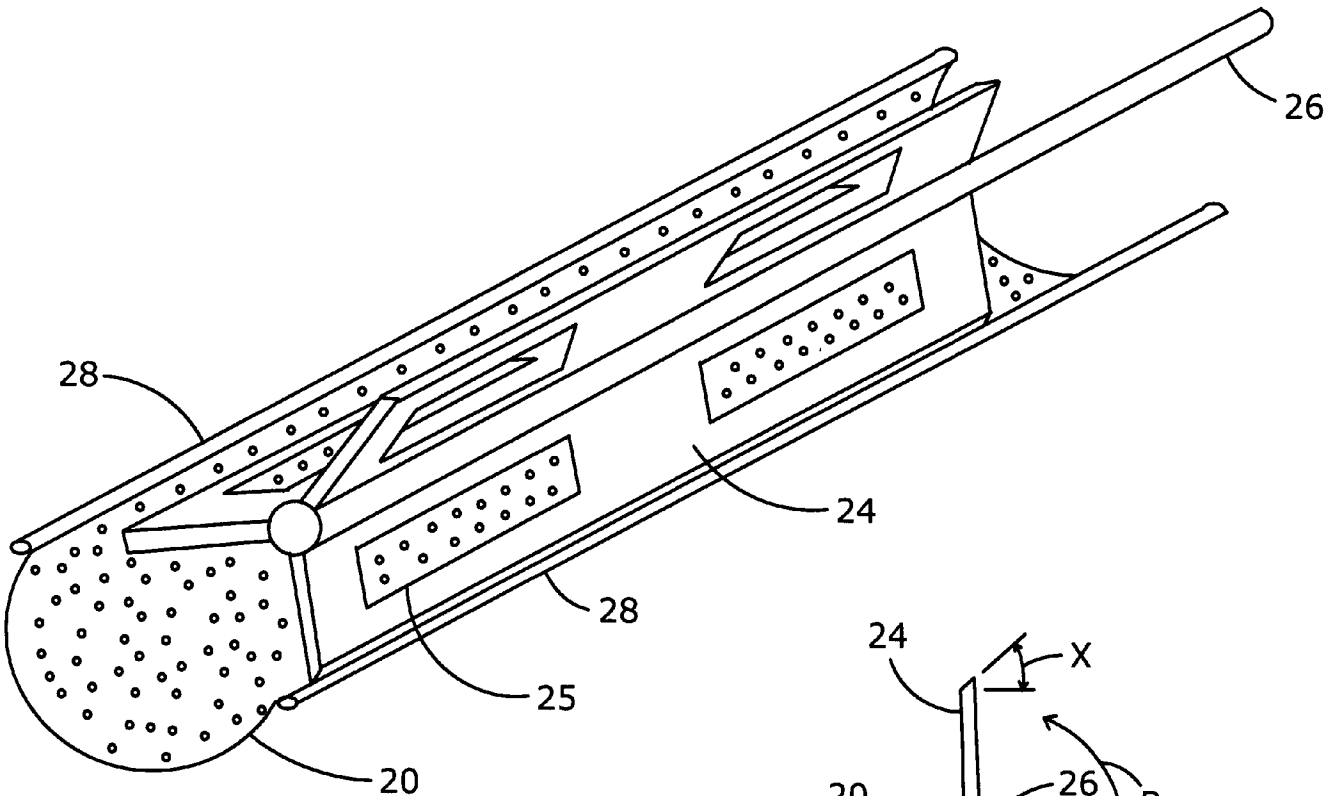
FIG. 3 is a perspective view of a screen and paddle used in the present invention according to a first embodiment.

Referring now to FIG. 3, screen 20 and paddle 24 mounted on shaft 26 are shown in perspective view. Screen 20 in the preferred embodiment is formed of a sheet of type 306 stainless steel, with the thickness of the sheet dependent on the size of tumbler used. Alternate materials may be used for screen 20 depending on the design purpose of the apparatus, including plastic resins. Screen 20 as a sheet structure is formed with a plurality of openings therethrough of a size to allow appropriate size particles to pass and be sifted, or separated. Screen 20 is preferably in a semi-tubular shape, i.e. with a uniform radius concentric to axis K (see FIG. 1) to conform to the turning radius of paddle 24 and maintain a maximum opening at the top of screen 20. A pair of channels 28 are formed along the upper edges of screen 20 to receive fasteners 22 (see FIG. 1), with channels 28 residing diametrically outside of screen 20. Alternatively, screen 20 may be formed from a woven wire screen and/or formed in an arcuate or spherical shape, with paddle 24 shaped appropriately. Paddle 24 is preferably formed with a plurality of blades, e.g. 3 blades, each blade having one or more windows 25 formed therethrough. The windows 25 help to break down hard lumps and serve as passages to permit a portion of powder to pass through and a portion of powder adjacent to a solid frame section to be pushed forward, thus mixing the powder further. In an alternate embodiment, paddle 24 may be replaced with an auger type mixer that is substantially equal in diameter to the inside of screen 20. In the embodiment where paddle 24 may be replaced with an auger, windows may be provided to serve similar purposes.

Figure 4:
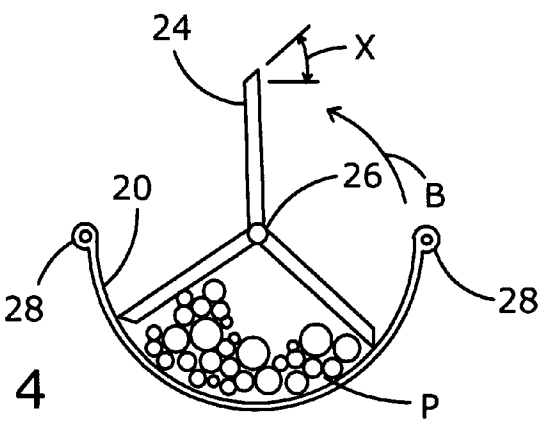
FIG. 4 is an end elevation view of the screen and paddle with a quantity of powders held therein.

Referring now to FIG. 4, screen 20 and paddle 24 are shown in end elevation view with a quantity of powder P being mixed thereby with channels 28 outside the structure of screen 20 to avoid contact with paddle 24. In a further feature of the invention, distal edge portions of each blade of paddle 24 are formed at an angle X to the length of the blade in the radius direction, angle X being preferably in the range of 10° to 45°. Angle X is oriented opposed to rotational direction B of paddle 24 so that as each blade passes screen 20, angle X presses some powder P through openings in screen 20 in a sifting operation. Forming the outer edge of each blade of paddle 24 at angle X further aids in the process of finely coating particles of powder P with a lubricating or protective layer, or coating fine particles of active ingredient on larger particles of inactive ingredient. To provide optimum effect of the angled blade edge, paddle 24 is mounted to place the edge of each blade in close proximity to screen 20. As portions of each blade edge pass over the areas of screen 20 between openings, the powder particulate and coating material are rolled and squeezed into intimate contact to optimize the adhesion therebetween.

Figure 5:
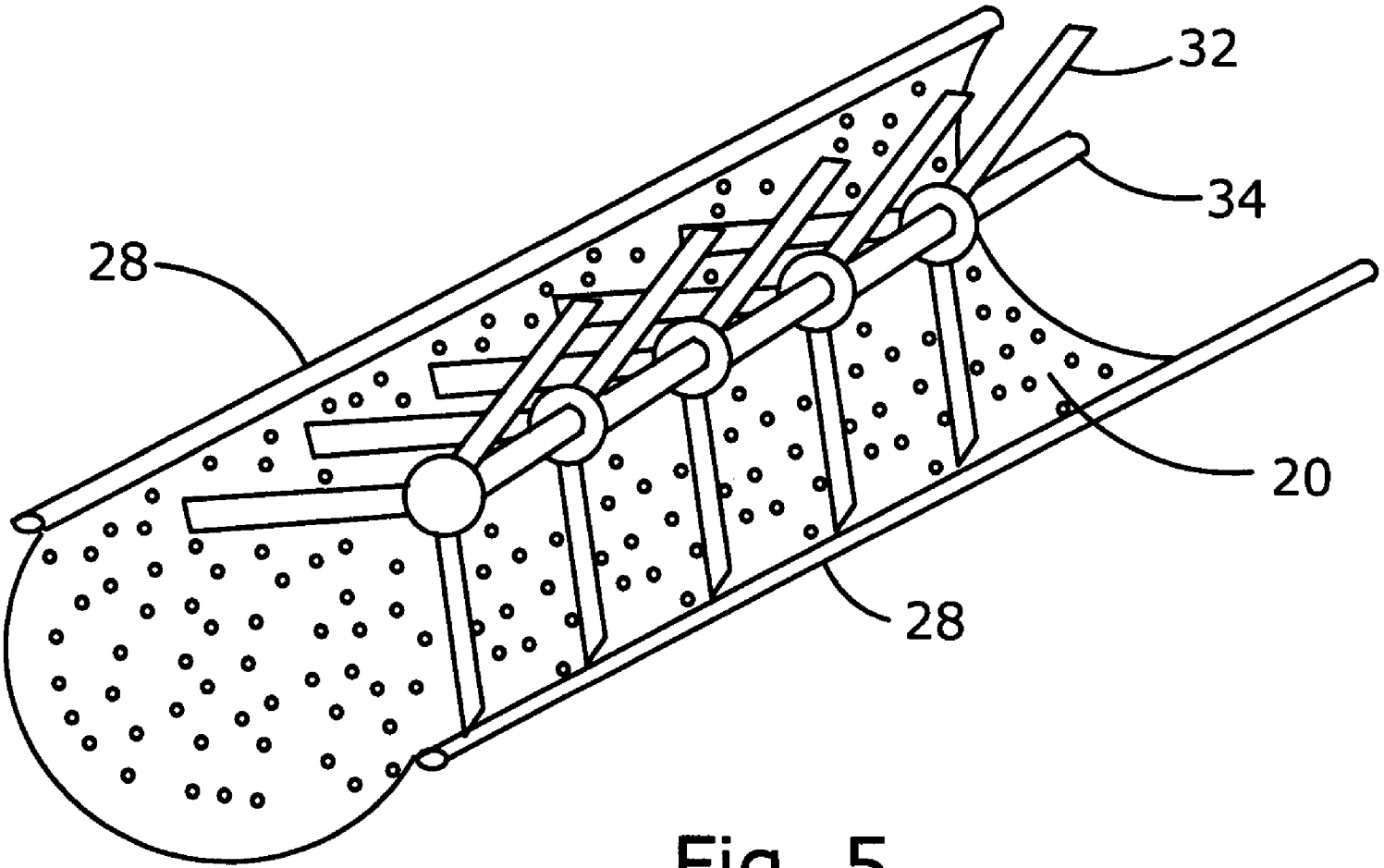
FIG. 5 is a perspective view of a screen and cutter used in the present invention according to a second embodiment.

Referring now to FIG. 5, a variation of the apparatus for practicing the invention method is illustrated in perspective view. Screen 20 is formed in an arcuate or semi-tubular shape with a channel 28 on opposed edges thereof. A series of cutters 32 are mounted radially on a shaft 34 that is mounted concentric with screen 20 and rotated. Cutters 32 may be tapered to form a sharp leading edge for breaking hard lumps and/or reducing the particle size of the ingredients while mixing.

While the description above discloses preferred embodiments of the present invention, it is contemplated that numerous variations and modifications of the invention are possible and are considered to be within the scope of the claims that follow.

What is claimed is:

1. A method for alternately sifting and blending powders in a single operation comprising the steps of:

a. placing a powder batch to be sifted and blended into a closed rotatable tumbler having a screen fixedly mounted and an agitator movably mounted therein;

b. rotating the tumbler to cause the powder batch to drop alternately between a top and a bottom of the tumbler;

c. catching a portion of the powder on the screen as the powder is being dropped toward the bottom of the tumbler; and d. moving the agitator to spread the powder on the screen and promote sifting.

2. The method described in claim 1, further comprising forming the screen arcuately, wherein the agitator comprises a rotatable paddle having multiple blades and the step of moving the agitator comprises rotating the paddle.

3. The method described in claim 2, further comprising the step of mounting the screen and the paddle concentric with one another.

4. The method described in claim 1, wherein the paddle is formed with a distal edge formed at an angle to a radial length thereof and the step of rotating the paddle further comprises forcing portions of the powder through the screen.

5. The method described in claim 4, further comprising the step of rotating the paddle in close proximity to the screen for encouraging adhesion between powder particulate and a coating material.

6. The method described in claim 1, further comprising continuing to rotate the tumbler and causing the portion of powder remaining on the screen to drop from the screen.

7. The method described in claim 1, further comprising repeating the steps of rotating the tumbler first to catch powder on the screen, rotating the paddle, and rotating the tumbler to drop powder from the screen to alternately sift and blend the powder.

8. The method described in claim 7, wherein different portions of powder are randomly caught and dropped from the screen in successive rotations of the tumbler.

9. The method described in claim 1, further comprising forming the paddle blades with windows therethrough and causing a portion of the powder to pass through the windows and a portion of the powder to be moved by the paddle blades surrounding the windows.

* * * * *